US006199325B1

(12) United States Patent
Winship

(10) Patent No.: US 6,199,325 B1
(45) Date of Patent: Mar. 13, 2001

(54) POWER SYSTEM FOR EXTENDING AND RETRACTING A STRUCTURE

(75) Inventor: David W. Winship, Altamont, IL (US)

(73) Assignee: Irwin Seating Company, Grand Rapids, MI (US)

( * ) Notice: Subject to any disclaimer, the term of this patent is extended or adjusted under 35 U.S.C. 154(b) by 0 days.

(21) Appl. No.: 09/260,968

(22) Filed: Mar. 2, 1999

(51) Int. Cl.[7] ..... E04H 3/12

(52) U.S. Cl. ..... 52/10; 318/466; 297/162; 297/232; 297/331

(58) Field of Search ..... 318/266, 286, 318/466–468; 52/6–10, 111, 116–118, 121; 297/14, 15, 16.1, 16.2, 232, 234, 235, 236, 240, 243, 311–316, 331–334, 340, 378.1

(56) References Cited

U.S. PATENT DOCUMENTS

| | | | |
|---|---|---|---|
| 295,094 | 3/1884 | Ayrton et al. . | |
| 446,679 | 2/1891 | Heermans . | |
| 511,727 | 12/1893 | Dean . | |
| 537,855 | 4/1895 | Roberts . | |
| 537,856 | 4/1895 | Roberts . | |
| 888,157 | 5/1908 | Giovannoni . | |
| 1,408,424 | 2/1922 | Grebler et al. . | |
| 1,414,724 | 5/1922 | Cunningham . | |
| 1,558,955 | 10/1925 | Welch . | |
| 1,788,302 | 1/1931 | Hummel . | |
| 1,831,128 | 11/1931 | McKenny et al. . | |
| 1,877,171 | 9/1932 | Hallenbeck . | |
| 1,938,071 | 12/1933 | Hummel . | |
| 2,020,632 | 11/1935 | Beeker et al. . | |
| 2,250,985 | 7/1941 | Benson . | |
| 2,569,557 | 10/1951 | Connelly . | |
| 2,898,639 | 8/1959 | Murphy . | |
| 3,013,763 | 12/1961 | Weberman . | |
| 3,053,344 | 9/1962 | Buck . | |
| 3,069,732 | 12/1962 | Murphy . | |
| 3,157,916 | 11/1964 | Puestow . | |
| 3,178,154 * | 4/1965 | McClelland | 52/10 X |
| 3,396,601 | 8/1968 | Wright . | |
| 3,488,898 * | 1/1970 | Scaggs | 52/10 |
| 3,749,202 | 7/1973 | Puls . | |
| 3,881,140 * | 4/1975 | Hartman | 52/10 X |
| 3,960,362 | 6/1976 | Griffiths et al. . | |
| 4,047,311 | 9/1977 | Kelley . | |
| 4,725,398 | 2/1988 | Ruckey et al. . | |
| 4,850,159 | 7/1989 | Conner . | |
| 5,040,846 | 8/1991 | Finney et al. . | |
| 5,559,411 | 9/1996 | Winship . | |
| 5,913,776 * | 6/1999 | Compagnone | 52/10 |

FOREIGN PATENT DOCUMENTS

| | | | |
|---|---|---|---|
| 2745803 * | 4/1979 | (DE) | 52/10 |

* cited by examiner

*Primary Examiner*—Richard Chilcot
(74) *Attorney, Agent, or Firm*—Van Dyke, Gardner, Linn & Burkhart, LLP

(57) ABSTRACT

A power system is provided for extending and retracting a telescopic seating structure. The power system includes a frame, a drum operably mounted on the frame for rotational movement, and a plurality of slidably interconnected telescoping members having a terminal telescoping member operably attached to the telescopic seating structure. A cable is wound about the drum and the plurality of telescoping members. Upon rotation of the drum in a selected direction, a tensional force is exerted upon the telescoping members causing their selective extension or retraction to thereby extend or retract the telescoping seating structure. A control assembly is operably connected to the drum shaft to thereby deactivate the power mechanism when the telescopic seating structure is filly extracted or retracted. A cable guide assembly is positioned below the drum to thereby ensure that the cable is properly wound upon the drum during rotation to thereby assure maximum efficiency of the power system.

42 Claims, 11 Drawing Sheets

POWER SYSTEM FOR EXTENDING AND RETRACTING A STRUCTURE

BACKGROUND OF THE INVENTION

The present invention relates generally to power systems, and in particular, to a non-friction power system for extending and retracting telescopic seating structures.

Telescopic seating structures, alternatively referred as collapsible bleachers, are typically located in church and school gymnasiums, as well as other public and private locations, to provide a seating arrangement for a relatively large number of people which, when not in use, may be stored in a compact and space-efficient manner. These collapsible bleachers normally include a series of interconnecting sections having positioned therebetween footboards and seatboards, which when in the extended position and viewed in profile, assume a "step" configuration, and enable individuals to sit thereon. The sections of the telescoping seating structure are interconnected such that when fully collapsed, assume a generally linear, vertical orientation.

Telescopic seating structures vary in both height and length, depending on the particular application, and when in the extended position, must be able to safely support a relatively large number of people. Consequently, such telescopic seating structures are normally quite heavy and therefore, if manually extracted and retracted, create challenges, none the least of which is the effort required by one or more persons to move the telescopic seating into position.

As a result, the industry has developed power driven systems which mechanically major advance and retract a telescopic seating structure. These power systems are of two types, namely, friction drive systems and non-friction drive systems. In friction drive systems, a drive wheel frictionally engages the floor under the telescopic seating to thereby move the same between a retracted and extended position. Frictional drive systems are seldom an acceptable solution to the problem of extending and retracting telescopic seating. This is so because the floor upon which the drive wheel rolls usually contains litter or debris which results in the loss of frictional contact between the floor and the drive wheel. This loss of frictional contact in turn results in the drive wheel becoming "caught" and merely rotating in place. Furthermore, over time, the frictional contact causes wear upon the drive wheel, which decreases the power system's ability to properly extend and retract the telescopic seating. Eventually, these drive wheels must be replaced, thereby increasing maintenance costs.

Given the problems with friction power systems, the industry has developed non-friction power systems which do not frictionally engage the floor. One commercially successful non-friction power system is disclosed in commonly assigned U.S. Pat. No. 5,559,411. In this system, an extendable chain, attached to the telescopic seating, is selectively wound and unwound about a drum to thereby extend or retracting the telescopic seating. The chain has a thickness such that successive wraps of the chain on the drum have an increased thickness, however, the power mechanism is configured to vertically raise and lower the drum so that the extended portion of the chain is tangentially aligned with the wound portion of the chain. This non-friction power system has overcome the problems associated with the friction power systems and has proven to be a durable and reliable apparatus for extending and retracting a telescopic seating structure. However, when used in conjunction with a relatively large telescoping seating structure, the increased diameter of the chain during retraction prevents the telescoping seating structure from assuming a completely closed, vertical profile.

In another common type of non-friction drive system, a plurality of telescoping members, controlled by a motor, ride along the floor and provide a force which moves the telescopic seating structure to the extended position or the retracted position. Although more reliable than friction drive systems, these non-friction drive systems are relatively large and bulky. Consequently, such systems can not be used with telescopic seating arrangements wherein it is desired to provide a slim profile when in the retracted position. Furthermore, these non-friction power systems are mechanically complex and are often attached to the underlying carriage of the telescopic seating structure. Therefore, such power systems, in order to maintain their operability, require frequent maintenance and adjustment and thereby increase the costs associated with their use. As a result, such non-friction power systems are relatively expensive, thereby precluding many potential customers such as schools and churches from purchasing them.

Consequently, there exists a need for a non-friction power system for extending and retracting a telescopic seating structure which is reliable, compact and economical to manufacture and maintain in operational condition.

SUMMARY OF THE INVENTION

The present invention provides a power system for extending and retracting telescopic seating structures. The power system includes a frame, a drum operably supported on the frame for rotational movement, and a plurality of side-by-side trolley or telescoping members which are adapted for connection to the telescoping seating structure. A transmitting member, such as a cable, is trained about the drum. Each telescoping member is formed with a plurality of pulleys and a pair of longitudinally positioned slots. The ends of the transmitting member are run through one of the slots and subsequently trained about the pulleys in a particular arrangement and thereafter enters the adjacent telescoping member. A power mechanism, mounted to the frame, is operably connected to the drum to rotate the drum in a selected direction. Rotation of the drum in a particular direction causes the transmitting member to place the telescoping members in a state of tension, resulting in their horizontal movement and thus selectively extending and retracting the telescopic seating structure.

According to an aspect of the invention, each telescoping member is formed with an upper and lower horizontal channel and an upper and lower flange. The upper and lower flanges are each fitted with a strip of material having a low coefficient of friction. The strip of material positioned on the upper and lower flange of the telescoping member is dimensioned to engage the upper and lower channel, respectively, of the adjacent telescoping member. This sliding interconnection between the telescoping members provides reliable and smooth movement as the telescoping members are moved between the retracted and extended position. Furthermore, by providing a low friction interconnection between the telescoping members, the power required to extend and retract the telescopic seating structure is greatly reduced. Additionally, by slidably interconnecting the telescoping members, when the power system is moved to the retracted position, the telescoping members are positioned in a compact side by side arrangement. This side by side arrangement permits the power system to fully retract the telescopic seating structure.

According to another aspect of the invention, the power system includes a control assembly operationally connected to the power mechanism and the drum shaft. The control assembly is configured to issue an electrical signal causing the deactivation of the power mechanism when the telescopic seating structure has achieved either the fully retracted or fully extended position. Deactivation of the power system upon full extension or retraction decreases power consumption and avoids unnecessary mechanical stresses on the power system to thereby maximize its economic life.

In a preferred embodiment, the control assembly includes a pair of clips placed in spaced relation and depending from the drum shaft, and a pair of limit switches attached to a second horizontal shaft positioned below the drum shaft. When the drum is rotated in a selective direction, the second shaft will move one of the limit switches into connection with the one of the clips to thereby deactivate the power mechanism.

According to another aspect of the invention, the power system includes a cable guide assembly positioned below the drum. The cable guide assembly reduces the slack in, and maintains the orientation of, the cable as the drum is rotated in a selective direction. As the drum rotates, the cable guide assembly assures that each successive winding of cable is placed adjacent the previous length of cable along the drum's exterior surface. Maintenance of the cable in the proper orientation assures efficient transfer of force to the telescoping members to thereby maximize the efficiency of the power system.

These and other features, advantages and objects of the present invention will be further understood and appreciated by those skilled in the art by reference to the following specification, claims and appended drawings.

DETAILED DESCRIPTION OF THE PREFERRED EMBODIMENTS

Figure 1:
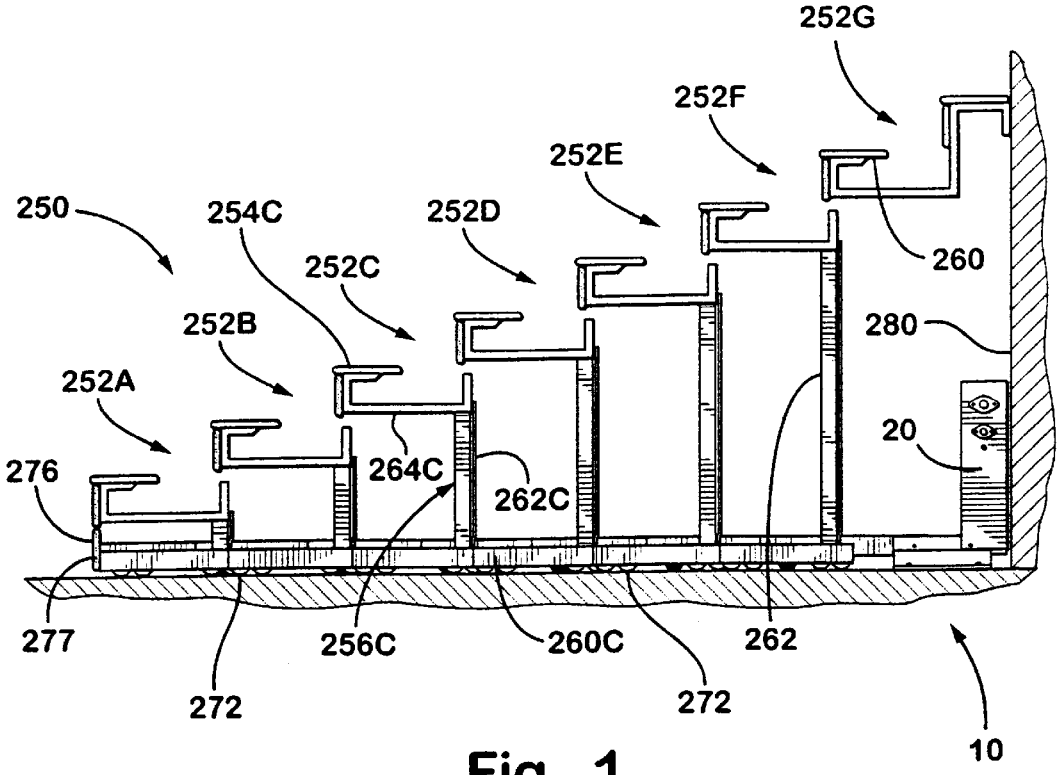
FIG. 1 is a side view of the power system of the present invention illustrated connected to a telescopic seating structure in the extended position.

A power system 10 embodying the present invention is provided for extending and retracting telescopic seating structure 250. The power system 10 (FIG. 5) includes a frame 20, a drum 50 mounted in frame 20 and configured for rotational movement, and a plurality of trolley or telescoping members 90, 91 and 92 adapted for connection to telescopic seating structure 250. Each telescoping member 90, 91 and 92 is oriented in a vertical direction, while the plurality of the telescoping members 90, 91 and 92 are slidably interconnected in a juxtaposed relationship. A transmitting member or cable 140 is trained about drum 50 and extends through each telescoping member 90, 91 and 92 in a manner which is discussed below. A power mechanism or motor 70, rigidly attached to back 22 of frame 20, is operably connected to drum 50 to thereby cause selective rotation of cable 140 about drum 50. The selective rotation of cable 140 about drum 50 affects the horizontal extension or retraction of telescoping members 90, 91 and 92 in a manner which in turn moves telescopic seating 250 between an extended position and a retracted position. Power system 10 provides a compact, energy efficient, low maintenance non-friction power system which effectively and efficiently extends and retracts telescopic seating 250.

Telescopic seating 250 (FIGS. 1 through 4) is supported by a collapsible assembly which includes a plurality of collapsible sections 252A through 252G, operably interconnected for telescopically collapsible movement. In FIGS. 1 through 4, only seven seating sections are shown, however it is contemplated that telescopic seating 250 may have any number of sections. Furthermore, it will be understood that other seating systems that are known in the art can be used with power system 10. Thus, the telescopic seating disclosed herein is for illustrative purposes only, and is not intended to be limiting.

Sections 252 A through G include complementary components that are folded into each other, as is generally known in the art, and thus only section 252C is described hereinafter to avoid redundant discussion. Section 252C includes a bleacher type seat 254C and a support structure 256C connected to seat 254C. Support structure 256C includes roller assemblies 260C, vertical beams 262C supported on roller assemblies 260C, and horizontal beams 264C supported on vertical beams 262C for supporting seats 254C. A cross support 268C is attached to vertical beam 262C and attached to rear surface 264C'. Roller assemblies 260C include an inverted elongated "U" shaped channel with multiple rollers 272 operably mounted therein. A front cross-beam 276 is attached to the front of telescopic seating 250 in front of roller assemblies 260. Front cross beam 276 holds a kick panel 277 along the front row of telescopic seating 250 and further provides structure for attachment of power system 10. It will be understood by those with ordinary skill in the art that the opposing side of telescopic seating 250 contains collapsible sections having the same structure as collapsible sections 252 A through G.

Referring now to FIGS. 5 through 14, frame 20 of power system 10 includes a top 24 attached to a back 22 and a pair of opposing sides 26 and 26'. Frame 20 is positioned beneath telescopic seating 250, and preferably, space against back wall 280. A pair of legs 32 and 32' extend horizontally from the inner surface 27 of opposing sides 26 and 26' and extend in a horizontal direction along the floor 200. Exterior surface 33 of legs 32 and 32' are attached to L-shaped members 36 and 36' which depend below bottom surface 34, to thereby support legs 32, 32' a preselected distance above floor 200. L-shaped members 36, 36' are secured to floor 200 by any means commonly employed in the art. For example purposes only, L-shaped members 36, 36' may be formed with a series of apertures dimensioned to receive bolts 37' or other fasteners. Extending horizontally from leg 32' is a pair of attachment channels 38 placed in spaced relation. Back 22 of frame 20 is formed with apertures 23 enabling frame 20 to be secured to a wall by bolts or like fasteners.

Figure 5:
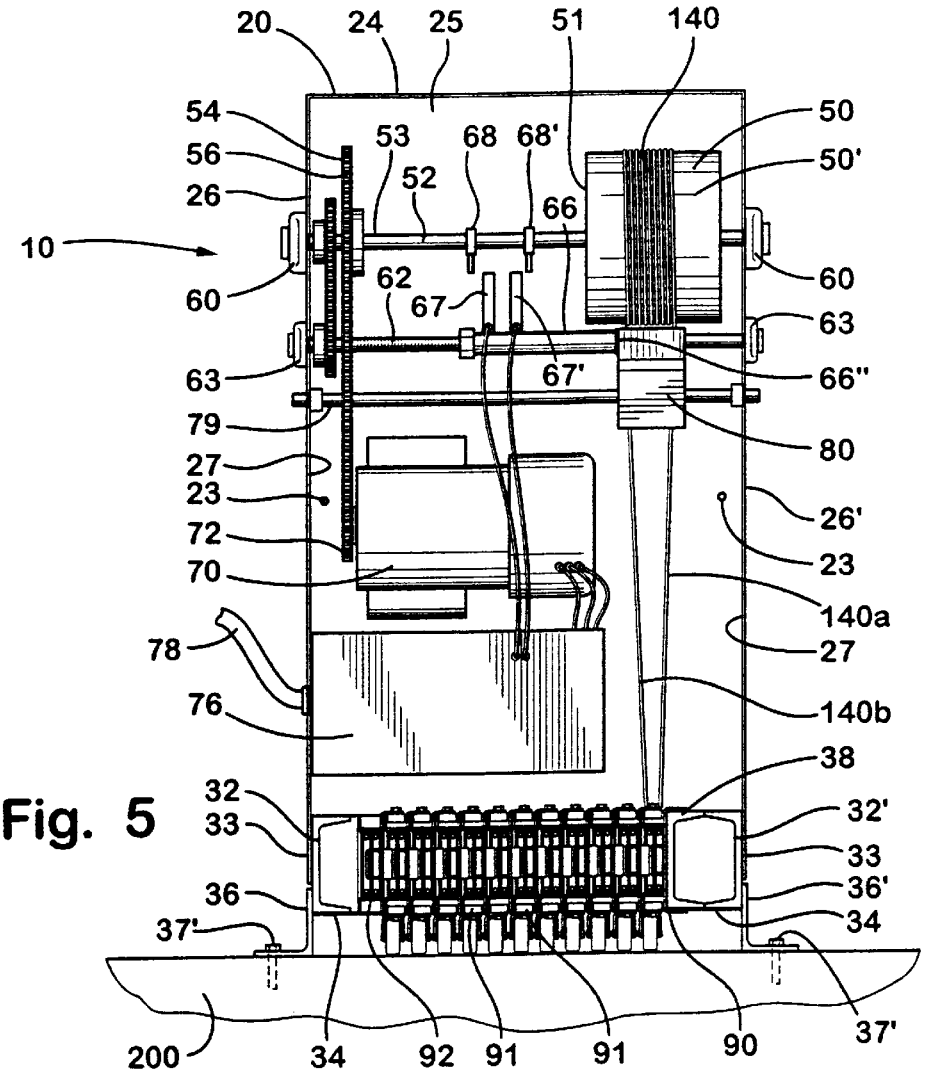
FIG. 5 is a front, partial cross-sectional view of the power system taken along line IV—IV of FIG. 4.
Figure 13:
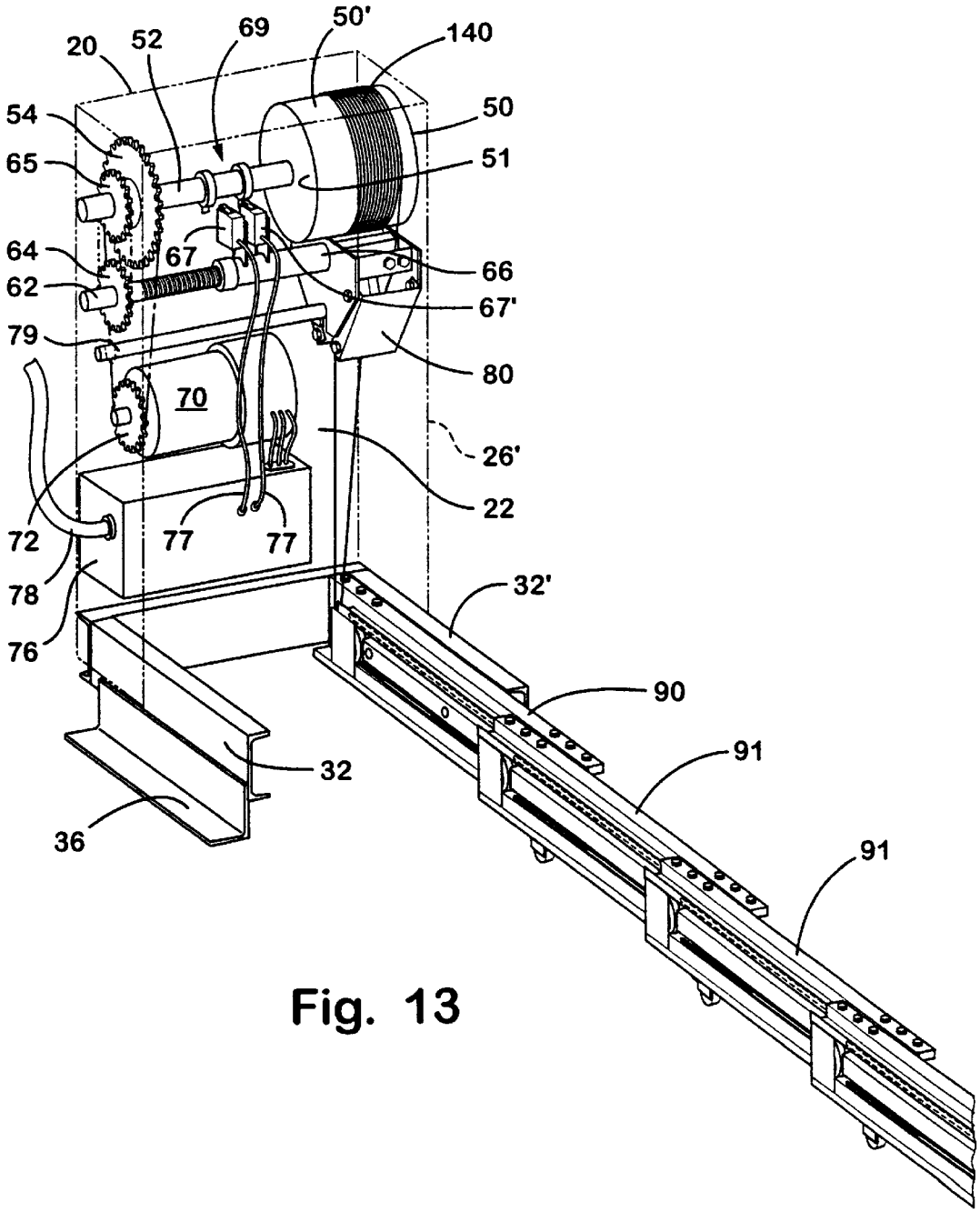
FIG. 13 is a perspective view of the power system depicting the telescoping members in extension with the frame depicted in phantom.
Figure 14:
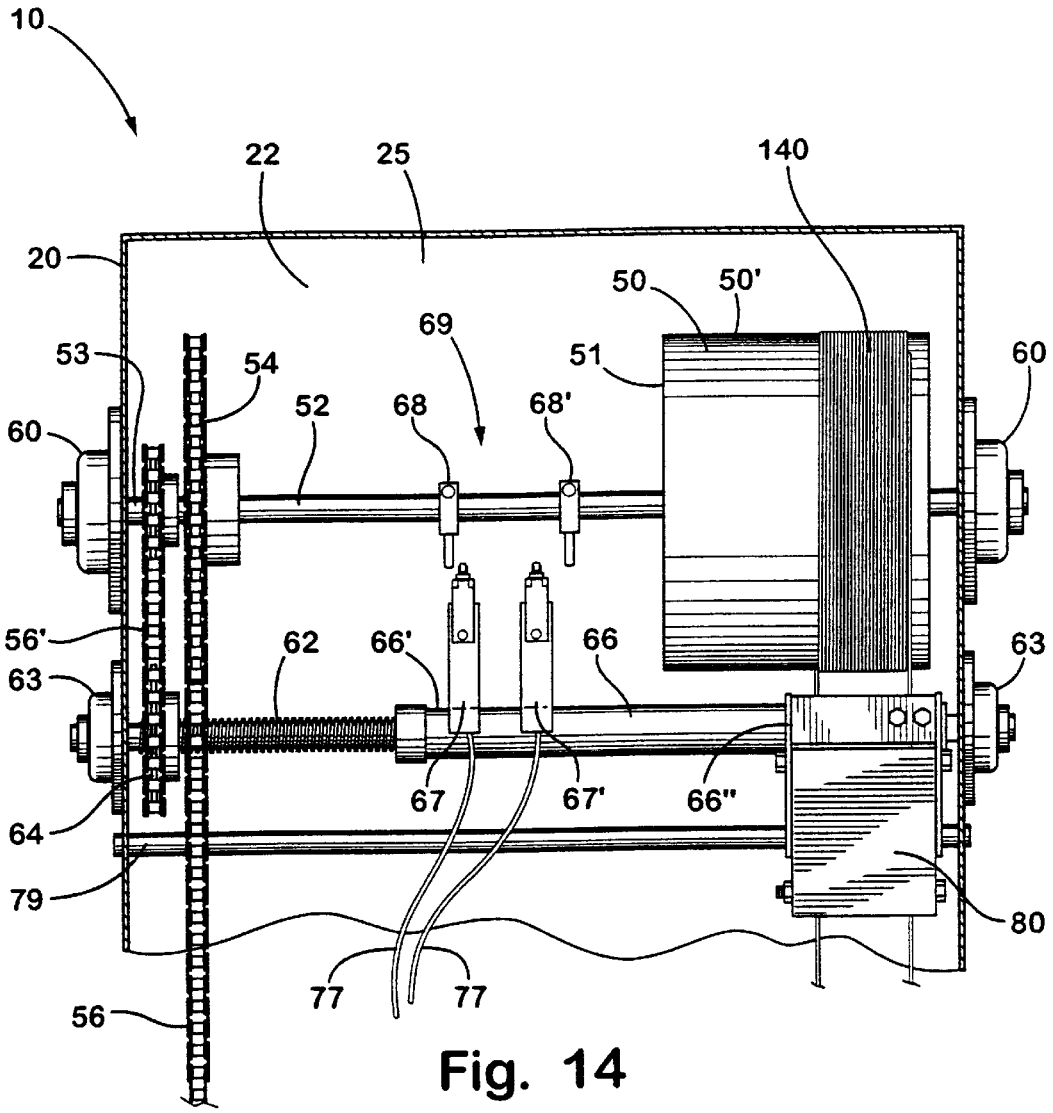
FIG. 14 is a detailed, perspective view of the control assembly of the power system.

Positioned within interior 25 of frame 20 is a drum 50 supported by a horizontal drum shaft 52. Drum shaft 52 is rotatably attached to opposing sides 26 and 26' of frame 20 in any manner commonly employed in the art. For example purposes only, drum shaft 52 is rotatably attached to sides 26, 26' by journals 60. Operationally attached to end 53 of drum shaft 52 is a gear 54. Gear 54 is operably connected to gear 72 of motor 70 by an endless chain 56. A control box 76, secured to back 22 of frame 20 is in electrical communication with motor 70, and upon issuance of a particular electrical signal, motor 70 affects the rotation of drum 50 in a particular direction. Control box 76 may be any electrical control mechanism normally encountered in the art. As illustrated in FIGS. 5 and 13, control box 76 has extending therefrom an electrical cable 78 which extends through a hole formed in side 26 of frame 20. Electrical cable 78 is attached to a remote control (not shown), enabling power system 10 to be remotely actuated by an operator positioned external to telescopic seating 250.

Positioned below drum shaft 52, within interior 25 of frame 20, is a second horizontal shaft 62 rotatably mounted to sides 26, 26' of frame 20 by journals 63. Second shaft 62 is externally threaded, and carries along its length an internally threaded cylindrical bar 66. End 66' of cylindrical bar 66 is fitted with a pair of limit switches 67 and 67' which extend in an upward direction and are placed in removable contact with a pair of spaced apart clips 68 and 68' depending from drum shaft 52. Limit switches 67, 67' are in electrical communication with control box 76 via electrical cables 77 and together with clips 68, 68' form a control assembly 69, the details of which will be discussed below.

Attached to opposing end 66" of cylindrical bar 66 is a cable guide assembly 80 positioned directly below drum 50. Cable guide assembly 80 maintains the proper orientation of a cable 140 trained about drum 50 and also takes up slack existing in cable 140. A horizontal bar 79 is rigidly attached to sides 26, 26' of frame 20 and positioned below second shaft 62. Horizontal bar 79 extends through the sides of guide assembly 80 and thereby provides horizontal alignment for cable guide assembly 80 as cable guide assembly 80 is moved horizontally along second shaft 62 as will be discussed in detail below.

Figure 8:
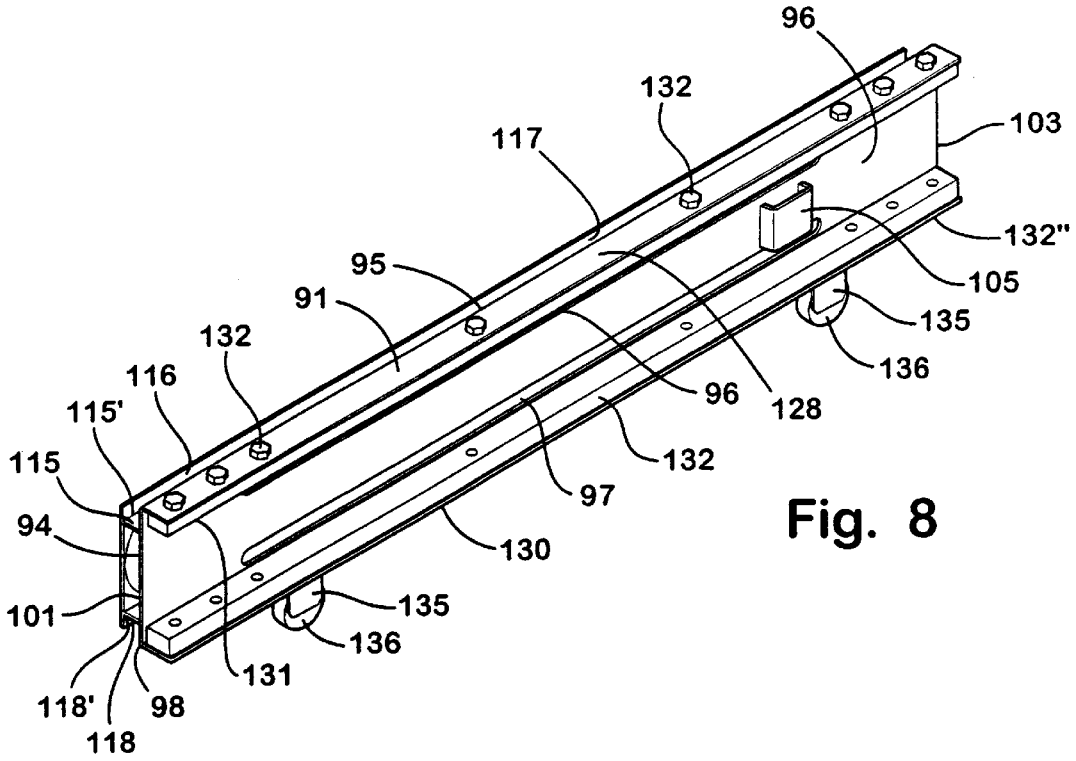
FIG. 8 is a side view of the opposing side of the intermediate telescoping member depicted in FIG. 7.

Power system 10 includes a primary telescoping member 90, a plurality of intermediate telescoping members 91 and a terminal telescoping member 92. Each telescoping member 90, 91 and 92 contains a first face or side 94 (FIG. 7) and a second side 96 (FIG. 8). Each telescoping member 90, 91 and 92 is formed with a first horizontal slot 96 positioned proximate to top 95 and a second horizontal slot 97 positioned proximate to bottom 98. Located between first horizontal slot 96 and second horizontal slot 97 is a horizontal member 99 extending from first side 94. Horizontal member 99 imparts rigidity and strength upon telescoping member 90, 91 and 92. Extending from first side 94 and positioned proximate to end 101 of each telescoping member 90, 91 and 92 is a horizontal first shaft 102. First shaft 102 receives a pair of pulleys 104 and 106. Pulley 104 is an inner pulley, being located proximate to, or against first side 94. An arcuate cable guard 108 is positioned between pulleys 104, 106 and end 101. Each telescoping member 90, 91, and 92 is formed with a second shaft 110 projecting from first side 94 and positioned proximate to end 103. Second shaft 110 receives a pair of pulleys 112 and 114 which are maintained in position by an arcuate cable guard 113. Pulley 112 is an inner pulley, being located proximate to or against first side 94.

Extending horizontally from first side 94 is a horizontal upper ledge or member 115 which is positioned above first slot 96 and below top 95. A lip 116 extends in an upward direction from end 115' of upper member 115. Together, first side 94, upper member 115, and lip 116, define an upper channel 117. A horizontal lower member 118 projects from first side 94. Lower member 118 is positioned below second slot 97 and above bottom 98. A downwardly extending lip 119 is formed at end 118' of lower member 118. Together, first side 94, lower member 118 and lip 119 define a lower channel 124. A cover plate 125 is positioned over pulleys 104 and 106 and attached to upper member 115 and lower member 118 by spot welding or similar method of securement. A cover plate 126 is positioned over pulleys 112 and 114 and secured to upper member 115 and lower member 118 by spot welding or like means of securement.

An upper flange 128 projects perpendicularly from top 95 of each telescoping member 90, 91, 92, while a lower flange 130 projects perpendicularly from bottom 98. As seen most clearly in FIG. 9, upper flange 128 and lower flange 130 extend in a direction away from upper horizontal member 115 and lower horizontal member 118. An upper slide member 131 is attached to under surface 128' of upper flange 128. Slide member 131 is preferably a strip of material having a low coefficient of friction. Most preferably, slide member 131 is made of nylon. Slide member 131 is attached to upper flange 128 by nut and bolt assemblies 132 which extend through apertures formed in upper flange 128. A lower slide member 132 is attached to upper surface 130' of lower flange 130. Slide member 132 is also preferably a strip of material having a low coefficient of friction. Slide member 132 is attached to lower flange 130 by nut and bolt assemblies 133 which are threaded through apertures formed in lower flange 130. Attached to under surface 130" of lower flange 130 is a pair of generally C-shaped carriages 135. Each carriage 135 supports a roller 136 to thereby enable intermediate telescoping members 91 and terminal telescoping member 92 to roll along floor 200.

Figure 6:
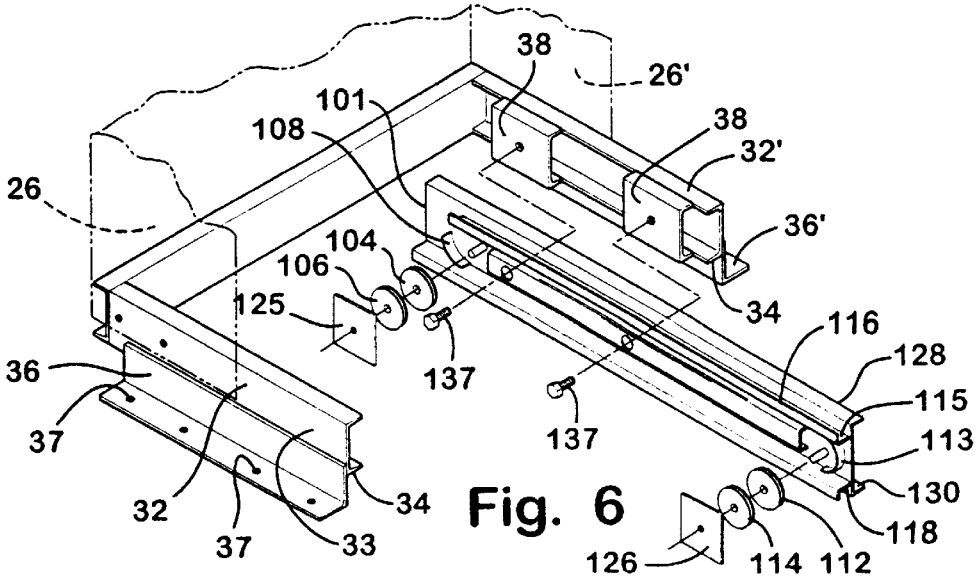
FIG. 6 is a detailed, exploded view depicting the attachment of the primary telescoping member to the frame of the power system.
Figure 7:
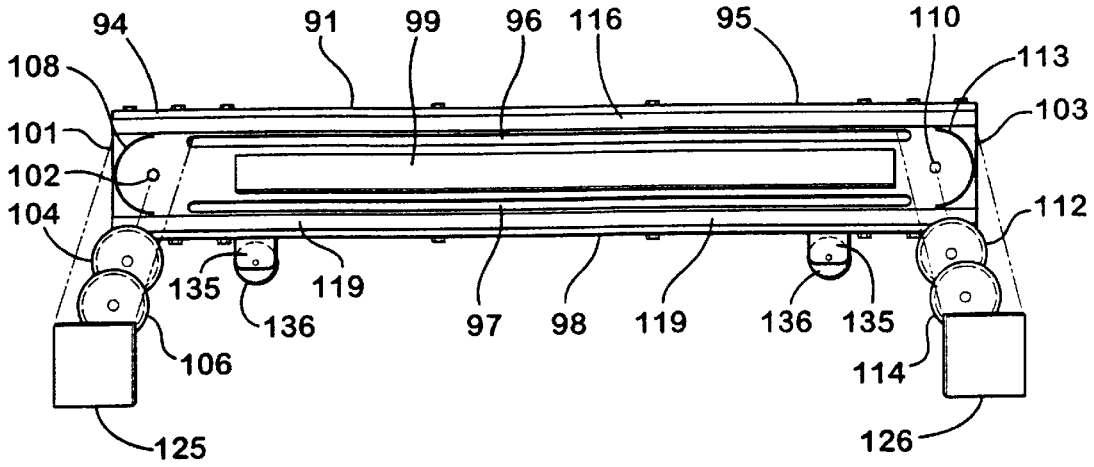
FIG. 7 is an exploded, side view of an intermediate telescoping member of the power system.

Referring now to FIG. 6, primary telescoping member 90 is attached to attachment channels 38, extending from leg 32', by bolts 137. Furthermore, upper member 115 and lip 116 terminate a preselected distance from end 101 of primary telescoping member 90, while arcuate cable guard 108, positioned proximate to end 101 is of a quarter circle shape to thereby enable segments **140*a* and 140*b* of cable 140 to be trained about the pulleys of primary telescoping member 90. In addition, as primary telescoping member 90 is attached to leg 32', primary telescoping member 90 is not formed with carriages 135 or rollers 136. In all other aspects, primary telescoping member 90 is structurally similar to intermediate telescoping members 91 and terminal telescoping member 92**.

Control assembly 69, positioned within interior 25 of frame 20, includes clips 68, 68' placed in space relation along drum shaft 52. Limit switches 67, 67' are positioned on second shaft 62 and extend in an upward direction to thereby permit removable contact with clips 68, 68'. Limit switches 67, 67' are movably carried on end 66' of cylindrical bar 66 positioned on second shaft 62. End 62' of second shaft 62 is formed with a gear 64 operably connected to gear 55 on drum shaft 52 by an endless chain 56'. In operation, when drum shaft 52 is rotated to cause telescoping members 90, 91 and 92 to selectively extend or retract telescoping seating 250, second shaft 62 rotates which in turn results in the translational horizontal movement of cylindrical bar 66 along second shaft 62. Horizontal movement of cylindrical bar 66 along second shaft 62 moves limit switch 67 into contact with clip 68 or limit switch 67' into contact with 68', depending upon the direction of rotation of second shaft 62. When contact is made between limit switch 67 or 67' and clip 68 or 68', respectively, an electrical signal is sent to control box 76 which causes the deactivation of motor 70. Specifically, when drum 50 is rotated in a clockwise direction as viewed from end 51 of drum 50, limit switch 67 will move in a direction towards clip 68. When telescopic seating 250 is fully retracted, limit switch 67 will contact clip 68 causing the deactivation of motor 70. When drum 50 is rotated in the counterclockwise direction as viewed from end 51 of drum 50 to extend telescopic seating 250, limit switch 67' will move in a direction towards clip 68'. Upon full extension of telescopic seating 250, limit switch 67' will contact clip 68' causing the deactivation of motor 70. The actual distance between clips 68 and 68' on drum shaft 52 is a function of the size of the telescopic seating 250 and the threads per inch of externally threaded second shaft 62 and is thus application specific.

Figure 17:
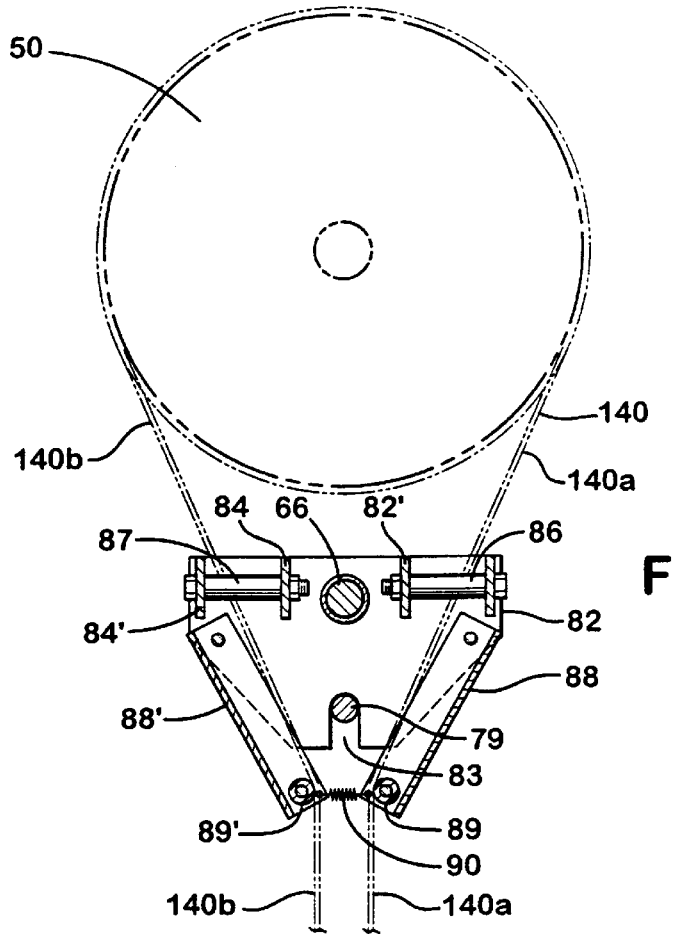
FIG. 17 is a cross-sectional view of the cable guide assembly, taken along line XVI—XVI of FIG. 16.
Figure 15:
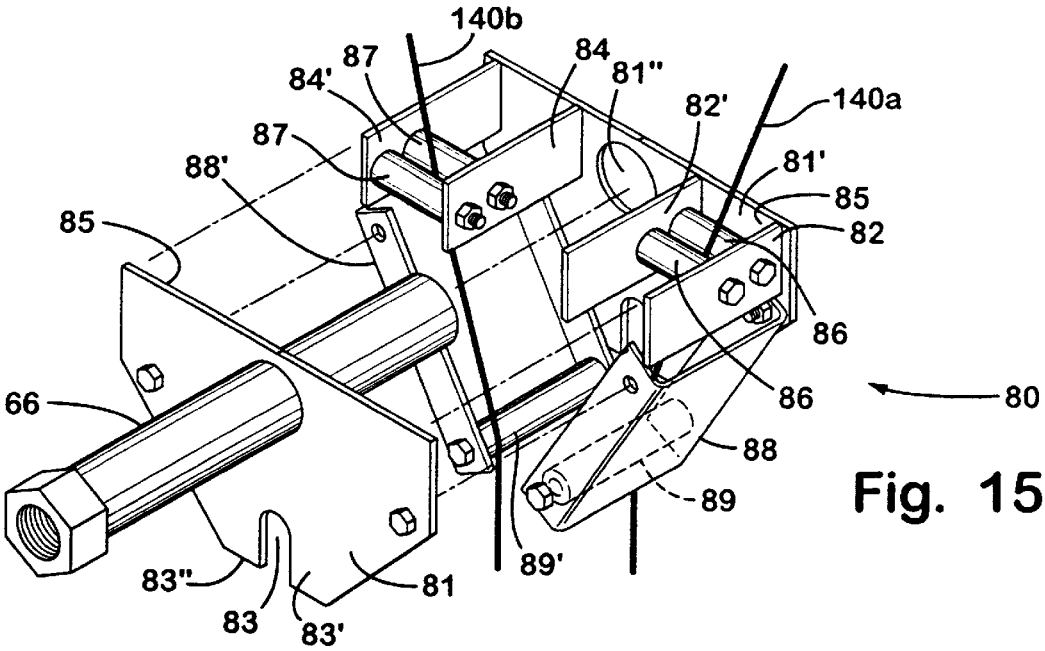
FIG. 15 is an exploded, perspective view of the cable guide assembly of the power system.
Figure 16:
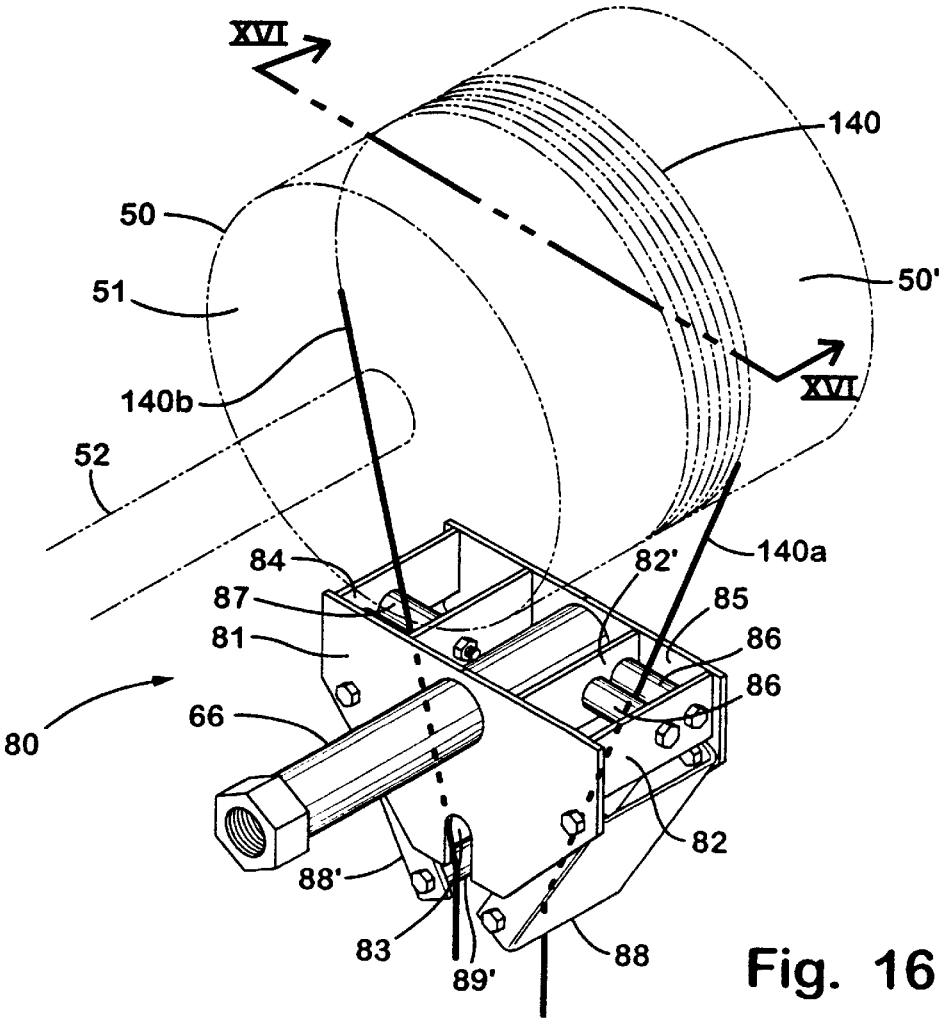
FIG. 16 is a perspective view of the cable guide assembly of FIG. 15 with the cable extending therethrough and the drum depicted in phantom.

With reference to FIGS. 15 through 17, cable guide assembly 80 is positioned on end 66" of cylindrical bar 66, directly below drum 50. Cable guide assembly 80 includes a pair of sides 81 and 81'. Cylindrical bar 66 extends through a hole formed in side 81 and is rigidly attached to side 81 ' while second shaft 62 extends through hole 81". A generally U-shaped recess 83 is formed in lower region 83' of each side 81, 81' and is dimensioned to receive horizontal bar 79. A plurality of transverse cross plates 82, 82', 84 and 84' are attached to inner surfaces 85 of sides 81, 81'. A first pair of horizontal cable guide rollers 86 are rotatably secured between cross plates 82 and 82' and positioned proximate to side 81'. A second pair of horizontal rollers 87 are rotatably attached to cross plates 84 and 84' and positioned proximate to side 81. A pair of generally C-shaped tension plates 88, 88' are attached to sides 81, 81', respectively, and depend below bottom surface 83". Each tension plate 88, 88' is formed with a horizontal tension roller 89 and 89' respectively, running perpendicular to sides 81 and 81'. A spring 90, attached to tension plates 88, 88', hold tension plates 88, 88' in an inwardly biased position. As shown most clearly in FIGS. 16 and 17, segment 140*a* of cable 140 is run between first pair of cable guide rollers 86, extends in a downward direction between tension rollers 89, 89', and contacts tension roller 89. Segment 140*b* of cable 140 is positioned between second pair of cable guide rollers 87, extends in a downward direction between tension rollers 89, 89', and contacts tension roller 89'.

In operation, as drum 50 is rotated, second shaft 62 will rotate causing the translational horizontal movement of cylindrical bar 66 along second shaft 62, which in turn moves cable guide assembly 80 therealong. The horizontal movement of cable guide assembly 80 assures that cable 140 will be wound upon drum 50 such that each successive wrap of cable 140 about drum 50 is in contact with surface 50' of drum 50 and positioned adjacent the previous wrap of cable 140. In addition, the inwardly biased tension plates 88, 88' biases segment 140*a* and 140*b* of cable 140 in a slightly inward horizontal direction to thereby remove any slack within cable 140.

Figure 10:
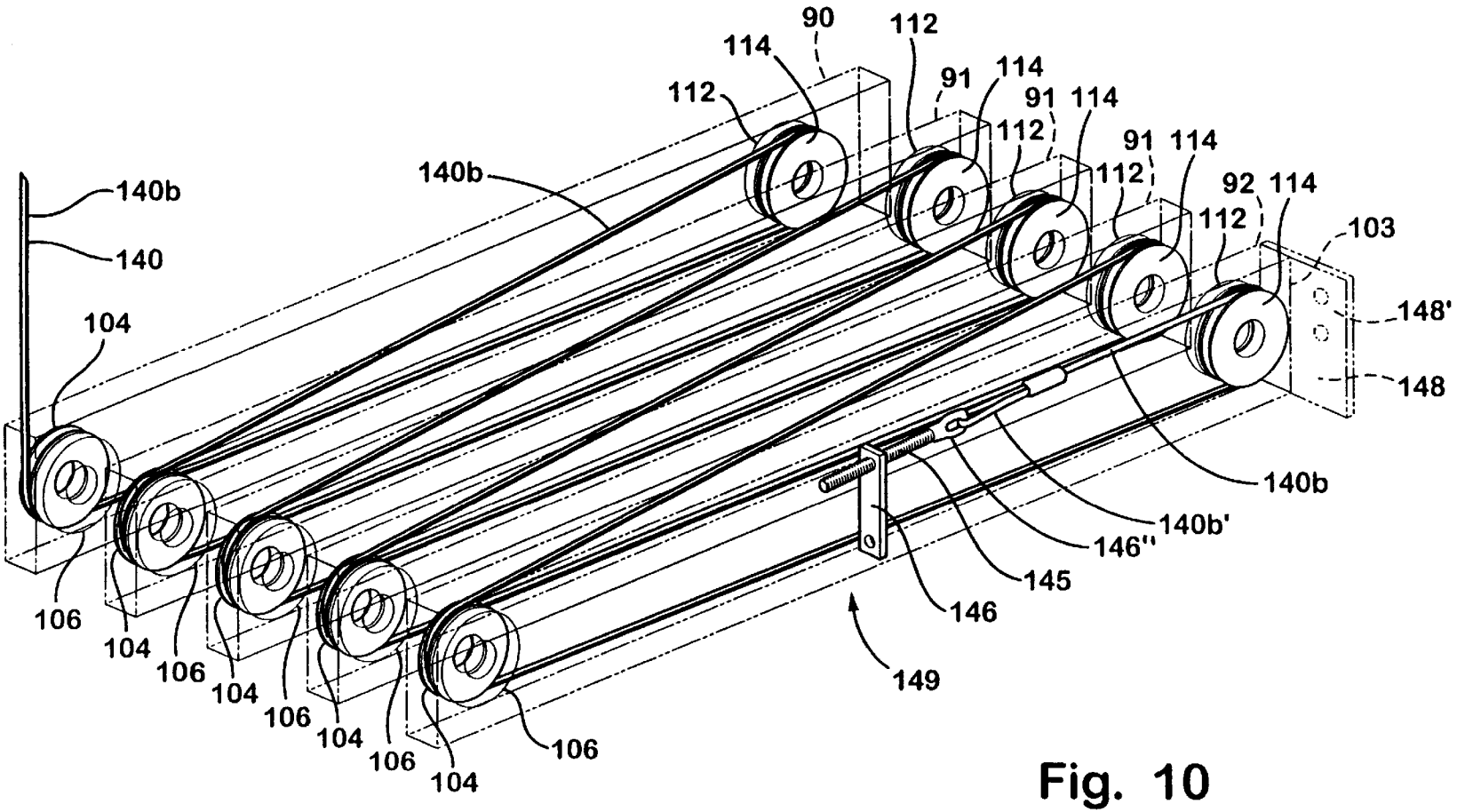
FIG. 10 is a perspective view of the telescoping members depicting the cable positioned therethrough, with the telescoping members depicted in phantom.
Figure 11:
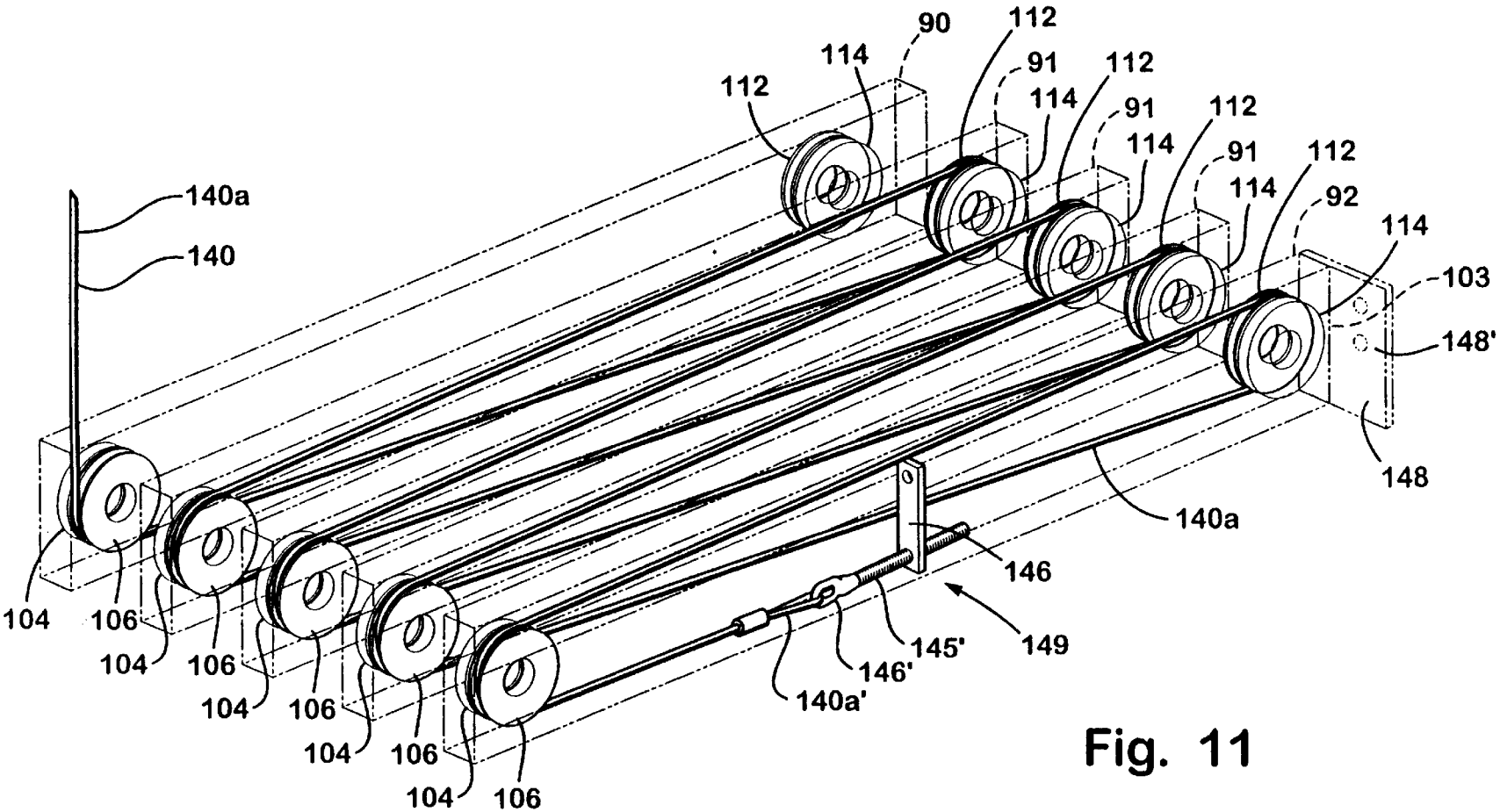
FIG. 11 is a perspective view of the telescoping members depicting the cable positioned therethrough, with the telescoping members depicted in phantom.

With reference to FIGS. 10 and 11, cable 140 is wrapped about drum 50 with segments 140*a* and 140*b* depending therefrom. In order to provide tension upon each telescoping member 90, 91, and 92 in the forward direction, and thereby enable power system 10 to selectively extend telescopic seating 250, segment 140*b* of cable 140 is would through the telescoping members 90, 91 and 92 as depicted in FIG. 10. In FIG. 10, segment 140*b* of cable 140 is first trained about pulley 104 and 114 of the primary telescoping member 90. Segment 140*b* is then threaded through first slot 96 and enters first slot 96 of intermediate telescoping member 91. Segment 140*b* is then wound about pulleys 104 and 114 of intermediate telescoping member 91 and exits therefrom via first slot 96. Upon entering the adjacent intermediate telescoping member 91, segment 140*b* is wound about pulleys 104 and 114 and exits via first slot 96. Upon entering the next intermediate telescoping member 91 through first slot 96, segment 140*b* is trained about pulleys 104 and 114. This serpentine winding of segment 140*b* of cable 140 through intermediate telescoping members 91 continues until segment 140*b* is trained about pulleys 104 and 114 of terminal telescoping member 92. Terminal telescoping member 92 is formed having a take up fitting 149 into which end 140*b'* of segment 140*b* is attached. Take up fitting 149 includes a vertical plate 146 having a bolt 145 threaded therethrough. Horizontal bolt 145 contains at its end a ring 146" through which end 140*b'* of segment 140*b* is placed. When drum 50 is rotated in the counterclockwise direction, as viewed from end 51 of drum 50, telescoping members 91 and 92 will be moved outwardly, away from frame 20, and thus extend telescopic seating 250.

In order to provide tension upon each telescoping member 90, 91, and 92 in the rearward direction, and thereby enable power system 10 to selectively retract telescopic seating 250, segment 140*a* of cable 140 is wound through each telescoping member 90, 91 and 92 as depicted in FIG. 11. In FIG. 11, segment 140*a* of cable 140 is first trained about the underside of pulley 106 of the primary telescoping member 90. Segment 140*a* is then threaded through second slot 97 and enters second slot 97 of intermediate telescoping member 91. Segment 140*a* is then wound about pulleys 112 and 106 of intermediate telescoping member 91 and exits therefrom via second slot 97. Upon entering the adjacent intermediate telescoping member 91, segment 140*a* is wound about pulleys 112 and 106 and exits via second slot 97. Upon entering the next adjacent intermediate telescoping member 91, segment 140*a* is trained about pulleys 112 and 106. This serpentine winding pattern of segment 140*a* of cable 140 through intermediate telescoping members 91 continues until segment 140*a* is trained about pulleys 112 and 106 of terminal telescoping member 92. Thereafter, end 140*a'* of segment 140*a* is attached to ring 146', located at the end of bolt 145' which is secured to vertical plate 146. When drum 50 is rotated in the clockwise direction, as viewed from end 51 of drum 50, telescoping members 91 and 92 will be drawn inwardly towards frame 20 and thereby retract telescopic seating 250. It will be recognized by those with ordinary skill in the art that although FIGS. 10 and 11 depict only three intermediate telescoping members 91, power system 10 may be manufactured to have as many intermediate telescoping members 91 as are necessary to filly extend and retract a particular telescopic seating structure.

Figure 12:
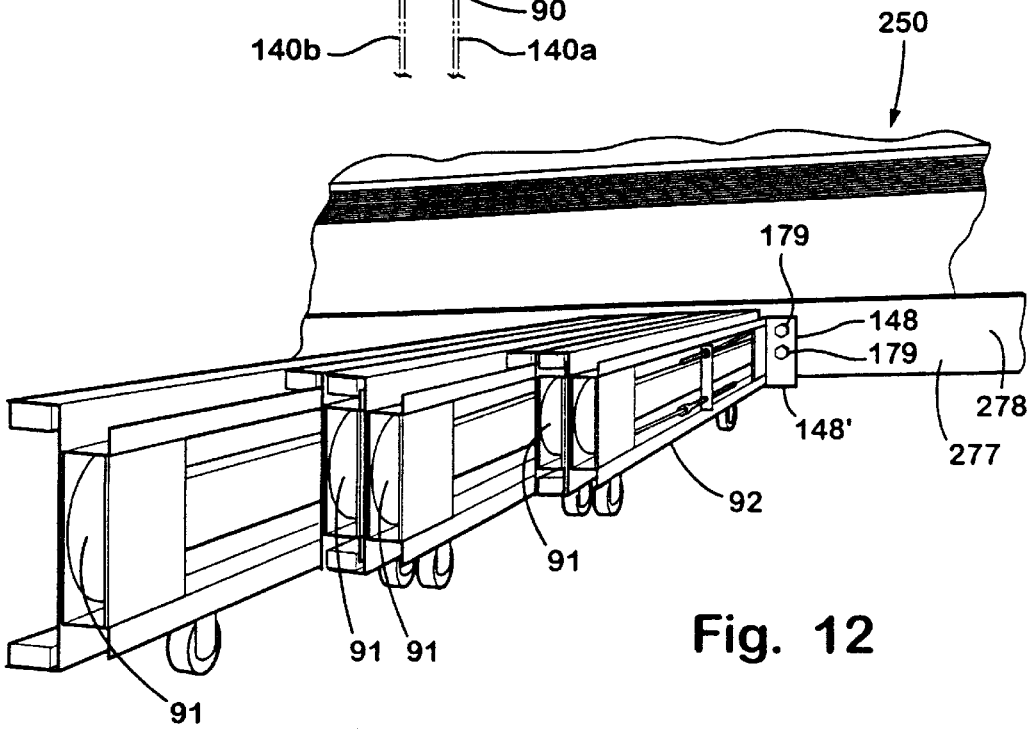
FIG. 12 is a perspective view depicting the attachment of the power system to the telescopic seating structure.

As illustrated in FIG. 12, terminal telescoping member 92 is formed having a bracket or anchor 148 attached to kick panel 277 of telescopic seating 250. Anchor 148 may be attached to end 103 of terminal telescoping member 92 by any means commonly employed in the art, such as, for example, spot welding. Anchor 148 is a generally L-shaped with a member 148' positioned flush against, and attached to, interior surface 278 of the kick panel 277. Nut and bolt assemblies 179 secure anchor 148 to kick panel 177. It will be understood that other means of attachment may be used in lieu of nut and bolt assemblies 179 without departing from the spirit and scope of the invention.

Figure 9:
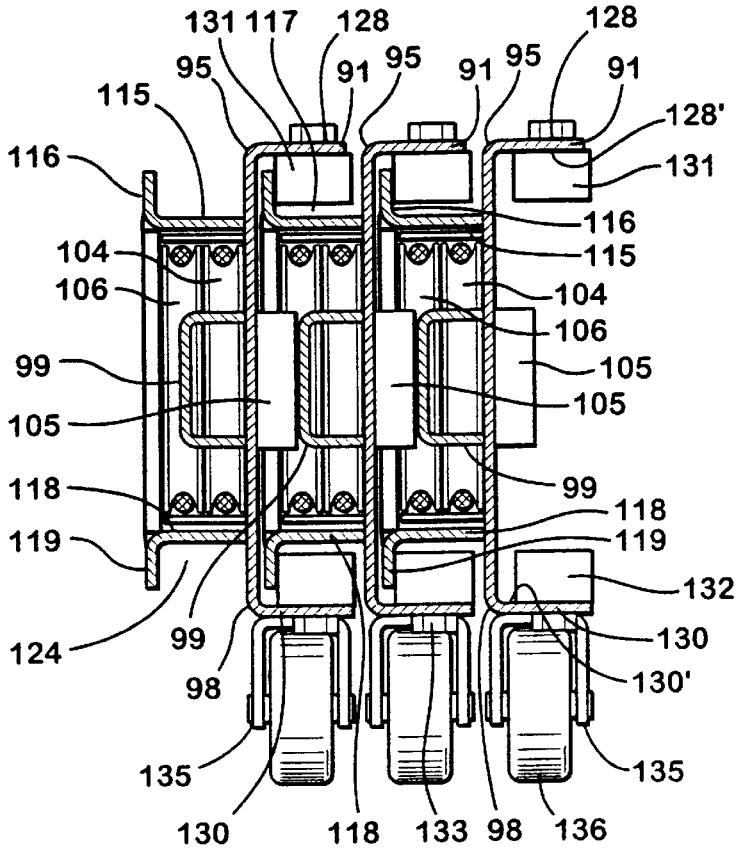
FIG. 9 is a cross-sectional view showing the interconnection between the telescoping members.

Seen most clearly in FIG. 9, telescoping members 90, 91 and 92 are slidably interconnected. This sliding interconnection is achieved by the placement of upper slide member 131, depending from upper flange 128, within the upper channel 117 of the adjacent telescoping member 91, or 92. In a similar fashion, lower slide member 132, extending from lower flange 130, is positioned within the lower channel 124 of the adjacent telescoping member 91 or 92. This sliding interconnection between telescoping members 90, 91 and 92 minimizes frictional resistance during the retraction and extension of telescopic seating 250 and thereby reduces the amount of power necessary to operate power system 10. Furthermore, the sliding interconnection between telescoping members 90, 91 and 92 permits all telescoping members 90, 91 and 92 to be nested between legs 32 and 32' when telescopic seating 150 is in the retracted position, and thus reduces the space utilized by power system 10.

A stop member 105 (FIG. 8) extends from second side 96 of each telescoping member 91 and 92 and is positioned proximate to end 103, between first slot 96 and second slot 97. As each telescoping member 91 and 92 is moved in a forward direction to extend telescoping seating 250, stop member 105 arrests the forward movement of a telescoping member 91 or 92 with respect to an adjacent telescoping member 91 or 92 by abutting cover plate 126 of the adjacent telescoping member 91 or 92. When telescoping members 91 and 92 are moved a rearward direction in order to retract telescoping seating 250, stop member 105 arrests rearward movement of a telescoping member 91 or 92 with respect to an adjacent telescoping member 91 or 92 by abutting cover plate 125.

Figure 2:
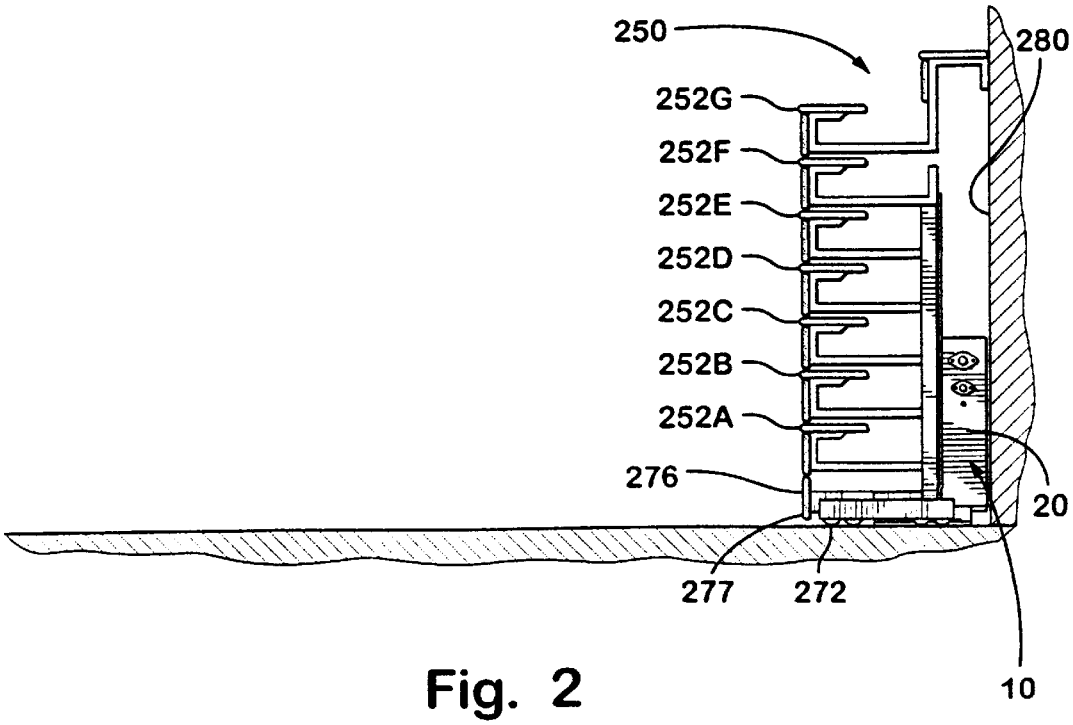
FIG. 2 is a side view of the power system and telescopic seating structure depicted in FIG. 1, with the telescopic seating structure shown in the retracted position.
Figure 3:
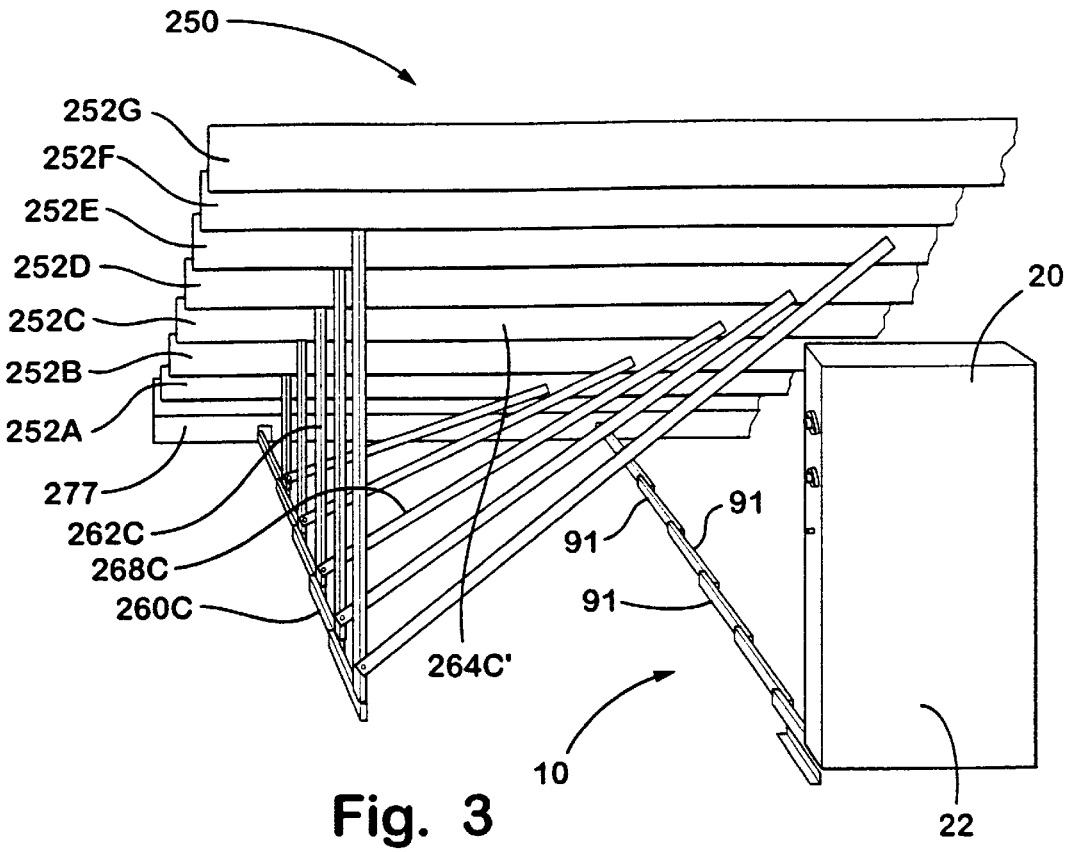
FIG. 3 is a rear perspective view of the power system and telescopic seating structure depicted in FIG. 1.
Figure 4:
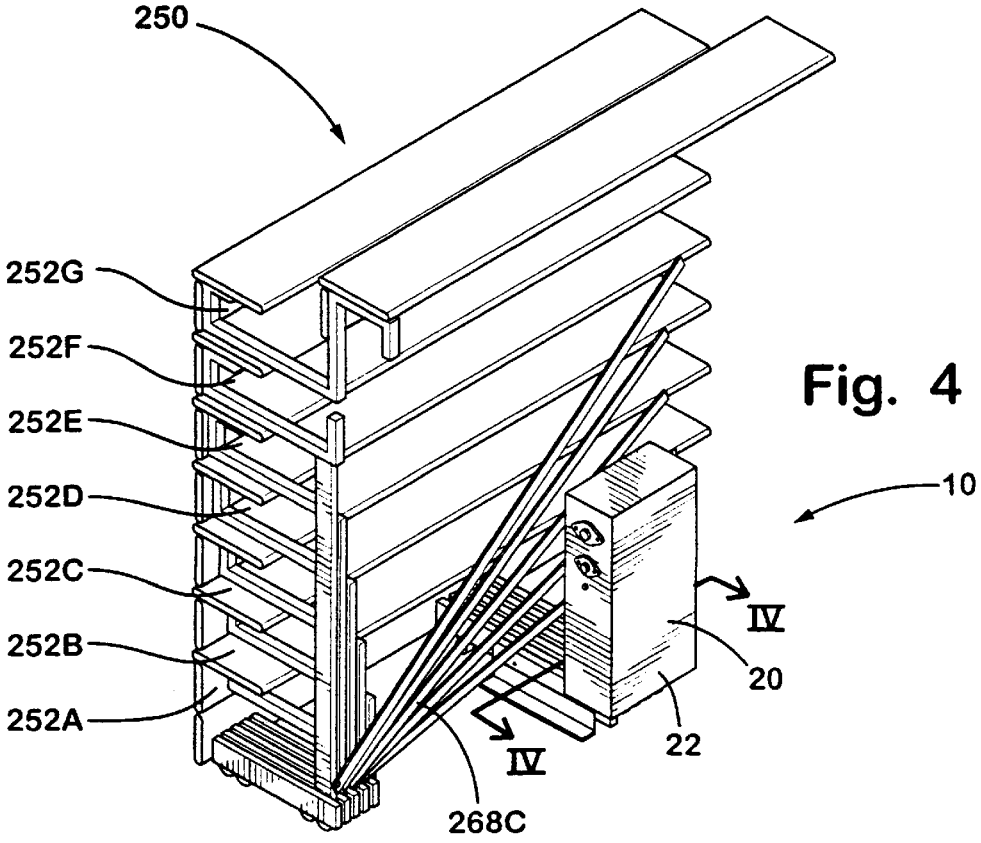
FIG. 4 is a rear perspective view of the power system and telescopic seating structure depicted in FIG. 2.

In operation, when telescopic seating 250 is in the fully retracted position as shown in FIGS. 2 and 4, telescoping members 90, 91 and 92 will be positioned in a side by side, interconnected arrangement between legs 32 and 32'. Upon actuation of motor 70, drum 50 rotates in a counterclockwise direction as viewed from end 51 of drum 50. This rotational movement of drum 50 exerts a force on terminal telescoping member 92 which in turn moves outwardly away from frame 20. Continued counterclockwise rotation of drum 50 will cause the successive horizontal movement of intermediate telescoping members 91 in an outward direction to thereby extend telescopic seating 250. Upon fill extension of seating 250, telescoping members 90, 91 and 92 will assume an end-to-end configuration, while limit switch 67' will contact clip 68' to thereby deactuate motor 70.

In order to retract telescopic seating 250, motor 70 is activated, causing drum 50 to rotate in a clockwise direction as viewed from end 51 of drum 50. The clockwise rotation of drum 50 provides a rearward force upon terminal telescoping member 92 causing it to move in a rearward direction towards frame 20. Continued rotation of drum 50 in the clockwise direction results in the successive rearward movement of each intermediate telescoping member 91. Upon complete retraction of telescopic seating 250, telescoping members 90, 91 and 92 will be positioned between legs 32 and 32', at which time switch 67 will contact clip 68 to thereby deactuate motor 70.

It will be recognized by those with ordinary skill in the art that although power system 10 has been described as fully extending or retracting telescopic seating 250, power system 10 is capable of partially extending or partially retracting telescoping seating 250. This is achieved by a stop and start switch located on the remote control (not shown) in electrical communication with control box 76.

The above description is considered that of the preferred embodiments only. Modifications of the invention will occur to those skilled in the art and those who make or use the invention. Therefore, it is understood that the embodiments shown in the drawings and described above are merely for illustrative purposes and are not intended to limit the scope of the invention, which is defined by the following claims as interpreted according to the principles of patent law, including the doctrine of equivalents.

The embodiments of the invention in which an exclusive property or privilege is claimed are defined as follows:

1. A power system for extending and retracting a telescopic seating structure comprising:

a rotatable drum fixedly positioned beneath the telescopic seating structure;

a plurality of juxtaposed telescoping members adapted for connection to the telescopic seating structure, each telescoping member of said plurality of telescoping members operably interconnected to each adjacent telescoping member and said drum, each telescoping member of said plurality of telescoping members configured to slidably interconnect with each adjacent telescoping member, said plurality of telescoping members configured to move along the floor; and a power mechanism operably attached to said drum, said power mechanism configured to rotate said drum in a selected direction, whereby rotating said drum selectively extends and retracts said plurality of telescoping members between an extended position and a retracted position.

2. The power system as recited in claim 1, further comprising a frame, wherein said drum and said power mechanism are attached to said frame.

3. The power system as recited in claim 2, further comprising a transmitting member trained about said drum and each telescoping member of said plurality of telescoping members.

4. The power system as recited in claim 3, wherein said transmitting member is a cable.

5. The power system as recited in claim 4, wherein each telescoping member of said plurality of telescoping members further comprises:

a first side and an opposing second side, a first end and an opposing second end;

a first pair of pulleys attached to said first side and positioned proximate to said first end; and a second pair of pulleys attached to said first side and positioned proximate to said second end.

6. The power system as recited in claim 5, wherein each telescoping member of said plurality of telescoping members further comprises:

a first cover plate positioned over said first pair of pulleys; and a second cover plate positioned over said second pair of pulleys.

7. The power system as recited in claim 5, wherein each telescoping member of said plurality of telescoping members is formed having a first slot and a second slot.

8. The power system as recited in claim 7, wherein said first slot formed in each telescoping member of said plurality of telescoping members is substantially horizontal and wherein said second slot formed in each telescoping member of said plurality of telescoping members is substantially horizontal.

9. The power system as recited in claim 5, wherein each telescoping member of said plurality of telescoping members has a top and a bottom and further comprises:

an upper member projecting from said first side, said upper member positioned proximate to said top, said upper member and said first side defining an upper channel therebetween;

an upper flange projecting from said top, said upper flange projecting in a direction opposite the direction of said upper member, said upper flange having a bottom surface; and a strip of material depending from said bottom surface, said strip of material dimensioned to be slidingly received by said upper channel of an adjacent telescoping member of said plurality of telescoping members.

10. The power system as recited in claim 9, wherein said upper member has an end and a lip projecting upward from said end.

11. The power system as recited in claim 9, wherein said strip of material is formed of a material having a low coefficient of friction.

12. The power system as recited in claim 5, wherein each telescoping member of said plurality of telescoping members further comprises:

a lower member projecting from said first side, said lower member positioned proximate to said bottom, said lower member and said first side defining a lower channel therebetween;

a lower flange projecting from said bottom, said lower flange projecting in a direction opposite the direction of said lower member, said lower flange having a top surface; and a strip of material carried by said top surface, said strip of material dimensioned to be slidingly received by said lower channel of an adjacent telescoping member of said plurality of telescoping members.

13. The power system as recited in claim 12, wherein said lower member has an end and a lip projecting downward from said end.

14. The power system as recited in claim 12, wherein said strip of material is formed of a material having a low coefficient of friction.

15. The power system as recited in claim 7, wherein said frame has a bottom region and a pair of spaced apart legs extending horizontally from said bottom region, and wherein said plurality of telescoping members further comprises:

a primary telescoping member, said primary telescoping member attached to a leg of said pair of legs; and at least one intermediate telescoping member, said at least one intermediate telescoping member having a bottom, said bottom having at least one roller depending therefrom.

16. The power system as recited in claim 15, wherein said plurality of telescoping members further comprises a terminal telescoping member, said terminal telescoping member attached to the telescopic seating structure, said terminal telescoping member having a bottom and at least one roller depending from said bottom.

17. The power system as recited in claim 7, wherein said first pair of pulleys is a first inner pulley and a first outer pulley and wherein said second pair of pulleys is a second inner pulley and a second outer pulley, wherein said cable is trained around said first outer pulley of said primary telescoping member and extends from said primary telescoping member through said second slot, wherein said cable enters said at least one intermediate telescoping member through said second slot and is trained about said second inner pulley and said first outer pulley of said at least one intermediate telescoping member.

18. The power system as recited in claim 15, wherein said first pair of pulleys is a first inner pulley and a first outer pulley and wherein said second pair of pulleys is a second inner pulley and a second outer pulley, wherein said cable is trained around said first inner pulley and said second outer pulley of said primary telescoping member and extends from said primary telescoping member through said first slot, wherein said cable enters said at least one intermediate telescoping member through said first slot and is trained about said first inner pulley and said second outer pulley of said at least one intermediate telescoping member.

19. The power system as recited in claim 3, further comprising a cable guide assembly movably attached to said frame, said cable guide assembly positioned below said drum, said cable guide assembly maintaining the orientation of said transmitting member such that each winding of said transmitting member around said drum is positioned on the surface of said drum.

20. The power system as recited in claim 1, further comprising a control assembly operably connected to said power mechanism, said control assembly deactivating said power mechanism when said plurality of telescoping members are in said retracted position, said control assembly deactivating said power mechanism when said plurality of telescoping members are in said extended position.

21. A power system for extending and retracting a telescopic seating structure, wherein the telescopic seating structure is supported by a collapsible assembly movable between an extended position wherein the telescopic seating structure is extended for use, and a retracted position wherein the telescopic seating structure is collapsed, the profile of the telescopic seating structure being greatly reduced in the retracted position as compared to the extended position, said power system comprising:

a rotatable drum fixedly positioned within and relative to the collapsible assembly of the telescopic seating structure; and a plurality of juxtaposed trolley members operably interconnected to the telescopic seating structure and said drum, said plurality of trolley members configured to move along the floor in a direction between the retracted position and the extended position, each trolley member of said plurality of trolley members being slidably interconnected with each adjacent trolley member whereby when the telescopic seating structure is in the extended position, said plurality of trolley members are fully extended essentially end to end, and are essentially side by side when the telescopic seating structure is in the retracted position, said trolley members being actuated for movement by rotation of said drum to thereby drive the telescopic seating structure to and between the extended position and the retracted position.

22. The power system as recited in claim 21, further comprising a frame, said frame supporting said drum.

23. The power system as recited in claim 22, further comprising a power mechanism supported by said frame, wherein said power mechanism is operationally connected to said drum.

24. The power system as recited in claim 23, further comprising a control assembly supported by said frame, said control assembly deactuating said power mechanism when the telescopic seating structure is in the extended position, said control assembly deactuating said power mechanism when the telescopic seating structure is in the retracted position.

25. The power system as recited in claim 24, further comprising a first shaft rotatably attached to said frame, said drum rotating about said first shaft, a second shaft rotatably attached to said frame and positioned below said first shaft, said second shaft in operable connection with said first shaft, and wherein said control assembly further comprises:

a pair of clips positioned in spaced relation on said first shaft; and a pair of switches movably attached to said second shaft, said pair of switches being in electrical connection with said power mechanism, whereby selective rotation of said second shaft moves a switch of said pair of switches into contact with a clip of said pair of clips and wherein contact between a switch of said pair of switches and a clip of said pair of clips deactuates said power mechanism.

26. The power system as recited in claim 25, wherein said second shaft is externally threaded, and wherein said pair of switches is carried by an internally threaded bar positioned on said second shaft.

27. The power system as recited in claim 21, further comprising a transmitting member, said transmitting member trained about said drum and each trolley member of said plurality of trolley members.

28. The power system as recited in claim 27, further comprising a cable guide assembly in operational connection with said drum, said cable guide assembly positioned below said drum, said cable guide assembly maintaining the orientation of said transmitting member such that each winding of said transmitting member around said drum is positioned on the surface of said drum.

29. The power system as recited in claim 28, further comprising a first shaft rotatably attached to said frame, said drum rotating about said first shaft, a second shaft rotatably attached to said frame and positioned below said first shaft, said second shaft in operable connection with said first shaft, said second shaft being externally threaded, and wherein said cable guide assembly is movably supported by an internally threaded bar positioned on said second shaft.

30. The power system as recited in claim 29, wherein said cable guide assembly further comprises:

a first plate having a hole formed therethrough;

a second plate placed in spaced relation to said first plate, said internally threaded bar extending through said hole formed in said first plate, said internally threaded bar attached to said second plate;

a first pair of transverse members attached to said first plate and said second plate;

a second pair of transverse members attached to said first plate and said second plate;

a first pair of rollers attached to said first pair of transverse members, said first pair of rollers positioned proximate to said first plate; and a second pair of rollers attached to said second pair of transverse members, said second pair of rollers positioned proximate to said second plate.

31. The power system as recited in claim 30, wherein said cable guide assembly further comprises:

a first tensioning member attached to said first plate and said second plate;

a first tensioning roller attached to said first tensioning member, said first tensioning roller positioned substantially perpendicular to said first plate and said second plate;

a second tensioning member attached to said first plate and said second plate; and a second tensioning roller attached to said second tensioning member, said second tensioning roller positioned substantially perpendicular to said first plate and said second plate.

32. The power system as recited in claim 31, wherein said first tensioning member and said second tensioning member are attached to a biasing member, said biasing member biasing said first tensioning member and said second tensioning member in an inwardly biased position.

33. A power system for extending and retracting a telescopic seating structure, comprising:

a frame positioned below the telescopic seating structure;

a rotatable drum attached to said frame;

a primary telescoping member attached to said frame;

at least one intermediate telescoping member slidably interconnected to said primary telescoping member, said at least one intermediate telescoping member configured to move along the floor;

a terminal telescoping member slidably interconnected to said at least one intermediate telescoping member, said terminal telescoping member configured to move along the floor, said terminal telescoping member attached to the telescopic seating structure; and a power mechanism configured to rotate said drum in a selected direction, whereby rotating said drum selectively extends and retracts said at least one intermediate telescoping member and said terminal telescoping member horizontally between an extended position and a retracted position.

34. The power system as recited in claim 33, wherein said frame has a bottom region and a pair of legs extending horizontally from said bottom region, said primary telescoping member attached to a leg of said pair of legs.

35. The power system as recited in claim 34, wherein said primary telescoping member, said at least one intermediate telescoping member, and said terminal telescoping member are positioned side by side between said legs when in said retracted position.

36. The power system as recited in claim 33, wherein said primary telescoping member, said at least one intermediate telescoping member, and said terminal telescoping member are positioned substantially end to end when in said extended position.

37. A power system for extending and retracting a telescopic seating structure, comprising:

a frame positioned beneath the telescopic seating structure;

a rotatable drum supported on said frame;

a plurality of telescoping members adapted for connection to the telescopic seating structure, said plurality of telescoping members configured to move along the floor;

a transmitting member trained about said drum and each telescoping member of said plurality of telescoping members;

a power mechanism supported by said frame, said power mechanism operably attached to said drum, said power mechanism configured to rotate said drum in a selected direction, whereby rotating said drum selectively extends and retracts said plurality of telescoping members between an extended position and a retracted position; and a cable guide assembly in operational connection with said drum, said cable guide assembly movably attached to said frame, said cable guide assembly positioned below said drum, said cable guide assembly maintaining the orientation of said transmitting member such that each winding of said transmitting member around said drum is positioned on the surface of said drum.

38. The power system as recited in claim 37, further comprising a first shaft rotatably attached to said frame, said drum rotating about said first shaft, a second shaft rotatably attached to said frame and positioned below said first shaft, said second shaft in operable connection with said first shaft, said second shaft being externally threaded, and wherein said cable guide assembly is movably supported by an internally threaded bar positioned on said second shaft.

39. The power system as recited in claim 38, wherein said cable guide assembly further comprises:

a first plate having an hole formed therethrough;

a second plate placed in spaced relation to said first plate, said internally threaded bar extending through said hole formed in said first plate, said internally threaded bar attached to said second plate;

a first pair of transverse members attached to said first plate and said second plate;

a second pair of transverse members attached to said first plate and said second plate;

a first pair of rollers attached to said first pair of transverse members, said first pair of rollers positioned proximate to said first plate; and a second pair of rollers attached to said second pair of transverse members, said second pair of rollers positioned proximate to said second plate.

40. The power system as recited in claim 39, wherein said cable guide assembly further comprises:

a first tensioning member attached to said first plate and said second plate;

a first tensioning roller attached to said first tensioning member, said first tensioning roller positioned substantially perpendicular to said first plate and said second plate;

a second tensioning member attached to said first plate and said second plate; and a second tensioning roller attached to said second tensioning member, said second tensioning roller positioned substantially perpendicular to said first plate and said second plate.

41. The power system as recited in claim 40, wherein said first tensioning member and said second tensioning member are attached to a biasing member, said biasing member biasing said first tensioning member and said second tensioning member in an inwardly biased position.

42. A power system for extending and retracting a telescopic seating structure between an extended position and a retracted position, comprising a plurality of trolley members operably interconnected to the telescopic seating structure, said plurality of trolley members configured to move along the floor, said plurality of trolley members driven by a drive system, whereby actuation of said drive system selectively extends and retracts said plurality of trolley members to thereby move the telescopic seating structure into and between the extended position and the retracted position, wherein said plurality of trolley members are positioned essentially end to end when the telescopic seating structure is in the extended position, and are essentially side by side when the telescopic seating structure is in the retracted position.

* * * * *

UNITED STATES PATENT AND TRADEMARK OFFICE

CERTIFICATE OF CORRECTION

PATENT NO. : 6,199,325 B1
DATED : March 13, 2001
INVENTOR(S) : David W. Winship

It is certified that error appears in the above-identified patent and that said Letters Patent is hereby corrected as shown below:

Title page,
Item [57], ABSTRACT,
Line 14, “filly” should be -- fully --;

Column 9,
Line 6, “filly” should be -- fully --;
Line 62, “fill” should be -- full --;

Column 12,
Line 7, “claim 7” should be -- claim 15 --.

Signed and Sealed this

Twenty-fourth Day of December, 2002

JAMES E. ROGAN
*Director of the United States Patent and Trademark Office*